US006422157B2

(12) United States Patent
Rumph

(10) Patent No.: US 6,422,157 B2
(45) Date of Patent: Jul. 23, 2002

(54) BANQUET TABLE WITH PIVOTABLE LEGS

(75) Inventor: Larry L. Rumph, Seymour, IN (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 09/742,783

(22) Filed: Dec. 20, 2000

Related U.S. Application Data

(60) Provisional application No. 60/172,933, filed on Dec. 21, 1999.

(51) Int. Cl.[7] ..... A47B 3/00
(52) U.S. Cl. ..... 108/132; 108/129
(58) Field of Search ..... 108/132, 131, 108/130, 129, 115, 133; 248/439

(56) References Cited

U.S. PATENT DOCUMENTS 2,680,662 A * 6/1954 Adler
2,730,418 A 1/1956 Blink
2,921,825 A * 1/1960 Spiegel
3,143,982 A 8/1964 Blink et al.
3,416,468 A 12/1968 Peterson et al.
3,661,100 A * 5/1972 Tennant
3,777,675 A * 12/1973 Hanusiak ..... 108/132
4,111,482 A 9/1978 Jones
5,284,100 A 2/1994 Thorn
5,357,872 A * 10/1994 Wilmore ..... 108/132 X
5,394,808 A 3/1995 Dutro et al.
5,540,158 A 7/1996 Ford
5,623,882 A 4/1997 Price
6,032,585 A 3/2000 Pinch
6,112,674 A * 9/2000 Stanford ..... 108/132

* cited by examiner

*Primary Examiner*—Jose V. Chen
(74) *Attorney, Agent, or Firm*—Barnes & Thornburg

(57) ABSTRACT

A table includes a tabletop including a top surface and a bottom surface, a pair of leg units, a pair of side members coupled to the bottom surface, and a pair of cross members. Each cross member is rotatably coupled to the pair of side members. Each leg unit is coupled to one of the cross members for pivotable movement between a collapsed position and an opened position supporting the tabletop. The side members and the cross members cooperate to form a continuous frame on the bottom surface.

41 Claims, 3 Drawing Sheets

BANQUET TABLE WITH PIVOTABLE LEGS

This application claims priority under 35 U.S.C. § 119(e) to U.S. Provisional Application Ser. No. 60/172,933, filed Dec. 21, 1999, which is expressly incorporated by reference herein.

BACKGROUND AND SUMMARY OF THE INVENTION

The present invention relates to a table, and particularly to a tabletop support unit. More particularly, the present invention relates to a tabletop support unit including pivotable leg units.

Many tables are configured to include a tabletop support unit. See, for example, U.S. Pat. No. 6,032,585 to Pinch, U.S. Pat. No. 5,623,882 to Price, U.S. Pat. No. 5,540,158 to Ford, U.S. Pat. No. 5,394,808 to Dutro et al., U.S. Pat. No. 5,284,100 to Thorn, U.S. Pat. No. 4,111,482 to Jones, U.S. Pat. No. 3,777,675 to Hanusiak, U.S. Pat. No. 3,416,468 to Peterson et al., U.S. Pat. No. 3,143,982 to Blink et al., and U.S. Pat. No. 2,730,418 to Blink.

According to the present invention, a table includes a table top, an endless, tubular frame coupled to the table top, and a pair of leg units coupled to the frame. Portions of the frame can rotate so that the leg units can swing between a collapsed, storage position and an opened, use position.

In preferred embodiments, the frame includes a pair of rotatable pivot bars and a pair of stationary pivot supports. The pivot bars and the pivot supports are connected end-to-end to form a closed loop. Each pivot bar is coupled to each pivot support so that each pivot bar can rotate inside each pivot support. Each end of each pivot bar is inserted into one of the ends of each pivot support for rotation. Each leg unit is coupled to one of the pivot bars so that each leg unit can swing back and forth when the respective pivot bar rotates.

Additional features of the present invention will become apparent to those skilled in the art upon consideration of the following detailed description of the invention exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
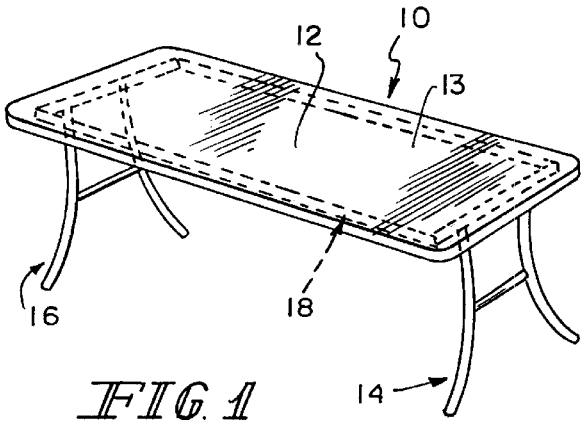
FIG. 1 is a perspective view of a table showing a table top, leg units under the left and right sides of the table top, and an endless support frame (shown in phantom) coupled to e underside of the table top.

Table 10 includes a table top 12 having a top surface 13 and a bottom surface on underside 15, a right-side leg unit 14, and a left-side leg unit 16. The leg units 14, 16 are mounted to pivot from a closed position shown in FIG. 3 to an opened position shown in FIGS. 1 and 4 to support table top 12 in an elevated position above the ground. An endless support frame 18 is mounted to underside 15 of table top 12 to rigidify table top 12 and each leg unit 14, 16 is coupled to endless support frame 18 to permit pivotable movement of leg units 14, 16 relative to table top 12 as shown, for example, in FIG. 3.

Figure 2:
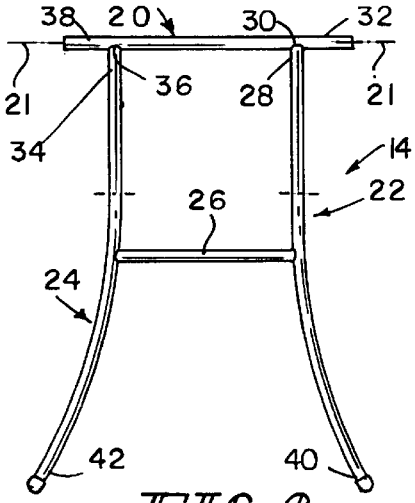
FIG. 2 is an elevation view of a horizontal first pivot bar and the rightside leg unit of FIG. 1 coupled to the first pivot bar.
Figure 3:
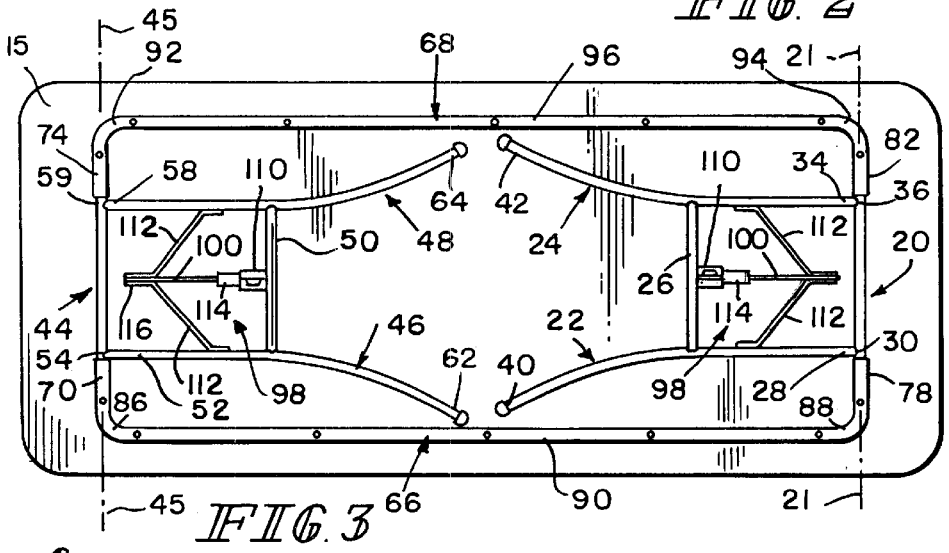
FIG. 3 is a bottom view of the table of FIG. 1 showing the two leg units in their collapsed, storage positions and showing the endless support frame including, in series, the first pivot bar along the right side of the table top, a first pivot support along the rear edge of the table top, the second pivot bar along the left side of the table top, and a second pivot support along the front edge of the table top.

Right-side leg unit 14 is coupled to a first cross member or pivot bar 20 as shown in FIG. 2 and first pivot bar 20 is one of the segments included in endless support frame 18 as shown, for example, in FIGS. 1 and 3. In use, first pivot bar 20 is mounted to be rotated about an axis of rotation 21 to pivot right-side leg unit 14 between the closed position shown in FIG. 3 and the opened position shown in FIGS. 1 and 4.

Right-side leg unit 14 includes first and second legs 22, 24 and a cross member 26 extending between first and second legs 22, 24 as shown in FIG. 2. An upper end 28 of first leg 22 is coupled to first pivot bar 20 at a first spot 30 that is spaced apart from a first end 32 of first pivot bar 20. An upper end 34 of second leg 24 is coupled to first pivot bar 20 at a second spot 36 that is likewise spaced apart from an opposite second end 38 of first pivot bar 20. Lower ends 40, 42 of first and second legs 22, 24 are adapted to engage the ground when right-side leg unit 14 is moved to assume its opened position as shown, for example, in FIGS. 1 and 4.

Figure 6:
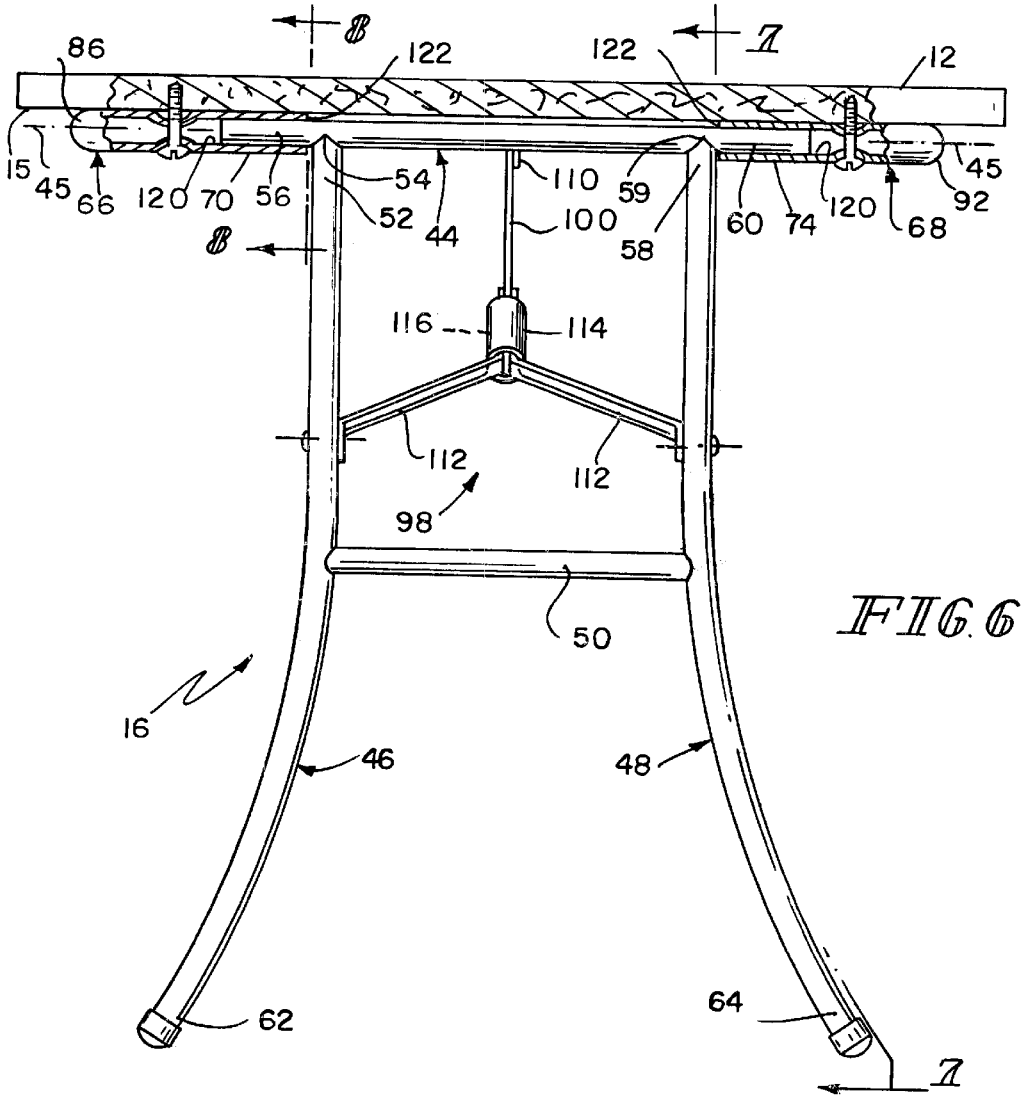
FIG. 6 is an elevational view of the table taken along line 6—6 of FIG. 4, with portions broken away, showing how opposite ends of the second pivot bar (attached to the left-side leg unit) are journaled for rotation in left-side bar mounts established in the left ends of the first and second pivot supports to enable the left-side leg unit to be pivoted from the collapsed, storage position shown in FIG. 3 to the opened position own in FIGS. 4, 6, and 7.

Left-side leg unit 16 is coupled to a second cross member or pivot bar 44 as shown in FIG. 6 and second pivot bar 44 is another one of the segments included in endless support frame 18 as shown, for example, in FIGS. 1 and 3. In use, second pivot bar 44 is mounted to be rotated about an axis of rotation 45 to pivot left-side leg unit 16 between the closed position shown in FIG. 3 and the opened position shown in FIGS. 1 and 4.

Left-side leg unit 16 includes first and second legs 46, 48 and a cross member 50 extending between first and second legs 46, 48. An upper end 52 of first leg 46 is coupled to second pivot bar 44 at a first spot 54 that is spaced apart from a first end 56 of second-pivot bar 44. An upper end 58 of second leg 48 is coupled to second pivot bar 44 at a second spot 59 that is likewise spaced apart from an opposite second end 60 of second pivot bar 44. Lower ends 62, 64 of first and second legs 46, 48 are adapted to engage the ground when left-side leg unit 16 is moved to assume its opened position as shown, for example, in FIGS. 1, 4, 6, and 7.

Figure 4:
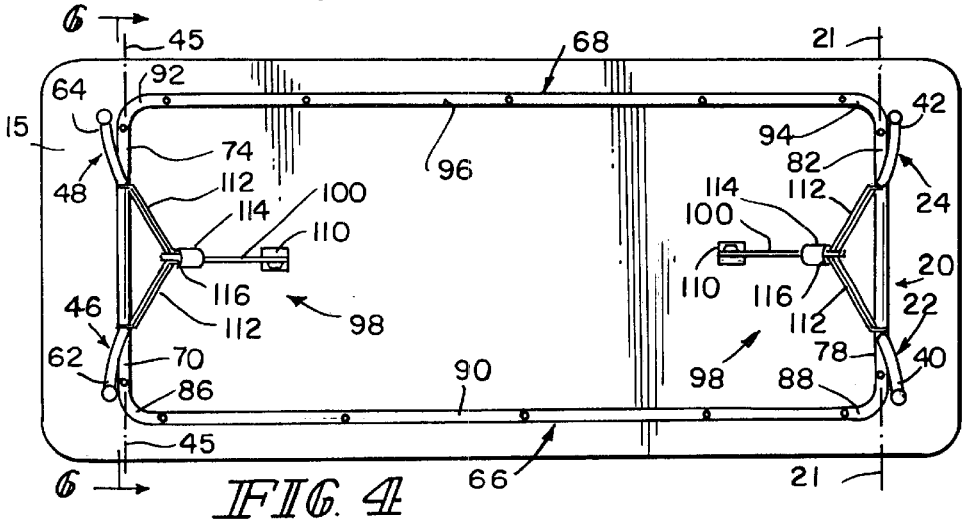
FIG. 4 is a view similar to FIG. 3 showing new positions of the leg units after the right-side leg unit has been pivoted about an axis extending through the first pivot bar to assume an opened position and the left-side leg unit has been pivoted about an axis extending through the second pivot bar to assume an opened position.

Endless support frame 18 also includes U-shaped first and second side members or pivot supports 66, 68 as shown in FIGS. 3 and 4 in addition to first and second pivot bars 20, 44. First and second pivot supports 66, 68 cooperate to support first and second pivot bars 20, 44 for rotation so that right-side and left-side leg units 14, 16 can be pivoted back and forth between the collapsed and opened positions shown in FIGS. 3 and 4. Endless support frame 18 includes, in series, first pivot bar 20 positioned to lie along a right side of table top 12, U-shaped first pivot support 66 positioned to lie along a rear edge of table top 12, second pivot bar 44 positioned to lie along a left side of table top 12, and U-shaped second pivot support 68 positioned to lie along a front edge of table top 12.

Second pivot bar 44 is coupled to left ends of first and second pivot supports 66, 68 so that second pivot bar 44 can be rotated about axis 45 during pivoting movement of left-side leg unit 16. First pivot support 66 includes a left-side bar mount 70 configured to receive first end 56 of rotatable second pivot bar 44 therein as shown in FIGS. 3, 6, and 8. Second pivot support 68 includes a left-side bar mount 74 configured to receive opposite second end 60 of rotatable bar 44 therein as shown in FIGS. 3, 5, 6, and 7.

First pivot bar 20 is coupled to right ends of first and second pivot supports 66, 68 so that first pivot bar 20 can be rotated about axis 21 during pivoting movement of right-side leg unit 14. First pivot support 66 includes a right-side bar mount 78 configured to receive first end 32 of rotatable first pivot bar 20 therein as shown in FIG. 3. Second pivot support 68 includes a right-side bar mount 82 configured to receive the opposite second end 38 of rotatable first pivot bar 20 therein as also shown in FIG. 3.

First pivot support 66 also includes a left curved portion or elbow 86 coupled to left-side bar mount 70, a right curved portion or elbow 88 coupled to right side bar mount 78, and a long straight rail 90 interconnecting left and right elbows 86, 88 and coupled to the rear edge of table top 12 as shown in FIG. 3. Likewise, second pivot support 68 also includes a left curved portion or elbow 92 coupled to left-side bar mount 74, a right curved portion or elbow 94 coupled to rightside bar mount 82, and a long straight rail 96 interconnecting left and right elbows 92, 94 and coupled to the front edge of table top 12 as shown in FIG. 3.

Each of bar mounts 70, 74, 78, 82 is arranged to form a passageway or channel 120 sized to receive respective end 32, 38, 56, 60. Each pivot support 66, 68 further includes a pair of annular-shaped end faces 122. Each end face 122 is included within respective bar mount 70, 74, 78, 82 and is formed to include a circular opening 124 that opens into respective channel 120. Each end 32, 38, 56, 60 extends through respective opening 124 into respective channel so that each end 32, 38, 56, 60 is connected to respective end face 122 and is journaled within respective bar mount 70, 74, 78, 82 for rotation therein. End faces 122 connected to first pivot bar 20 are positioned to lie in spaced-apart, facing relation. Similarly, end faces 122 connected to second pivot bar 44 are positioned to lie in spaced-apart, facing relation.

Figure 5:
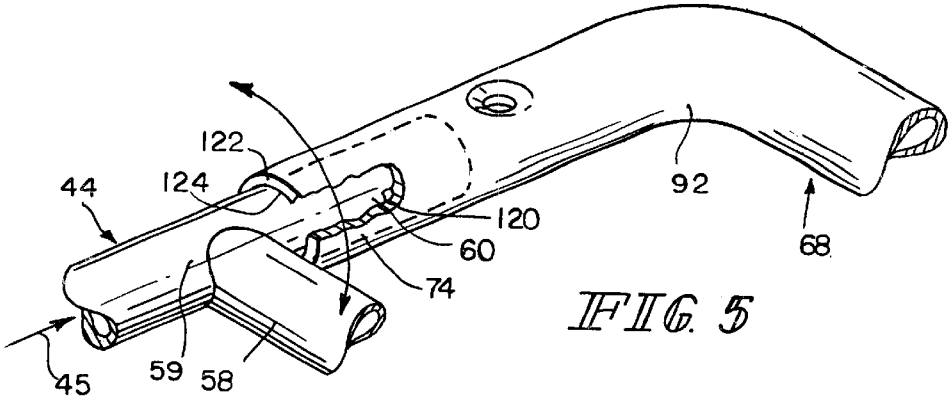
FIG. 5 is an enlarged perspective view, with portions broken away, of one end of the second pivot bar journaled in a left-side bar mount of the second pivot support enabling the left-side leg unit to pivot about the pivot axis extending through the second pivot bar
Figure 7:
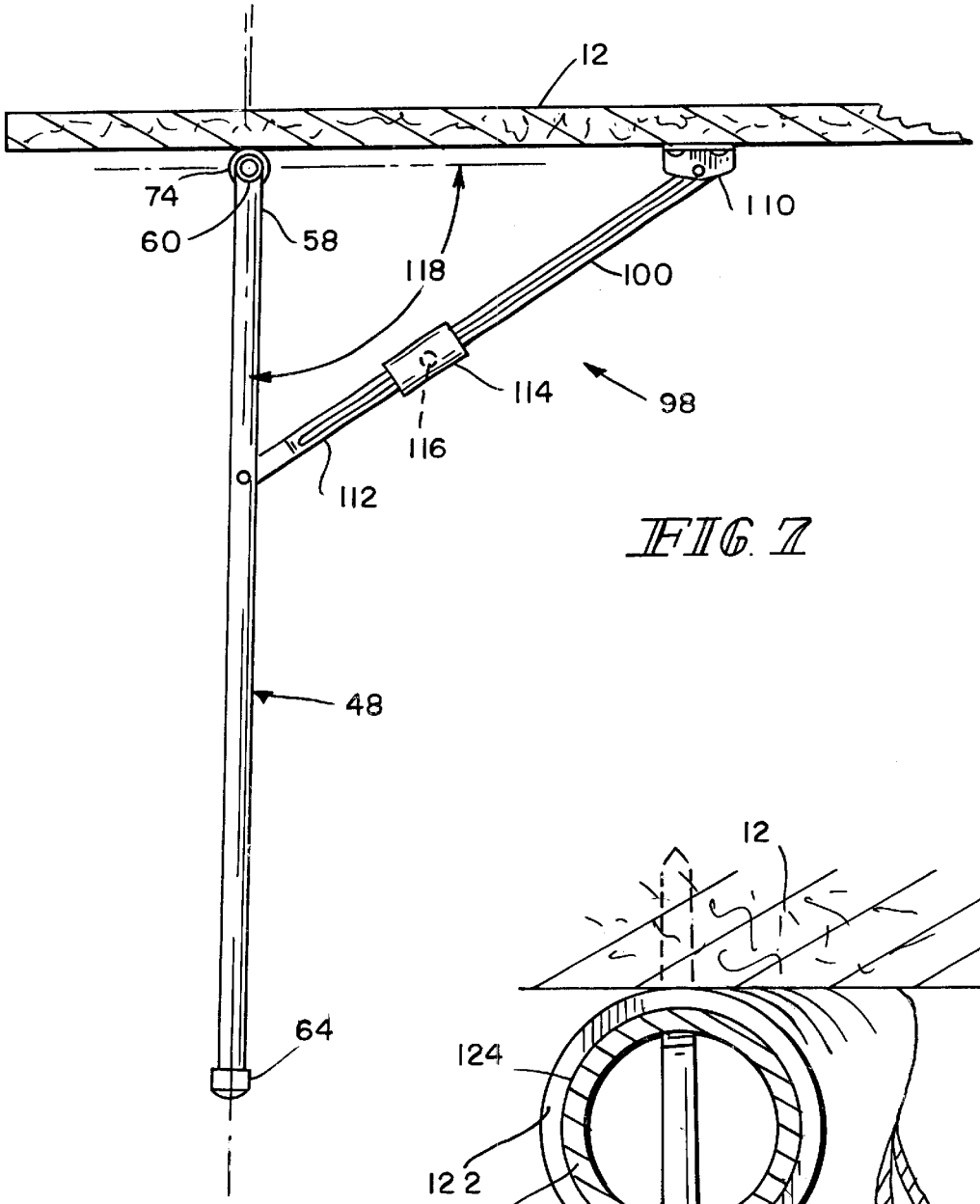
FIG. 7 is a side elevational view taken along line 7—7 of FIG. 6 showing one end of the second (left-side) pivot bar journaled in the left-side bar mount of the second pivot support and further showing the left-side leg unit locked in an opened position.
Figure 8:
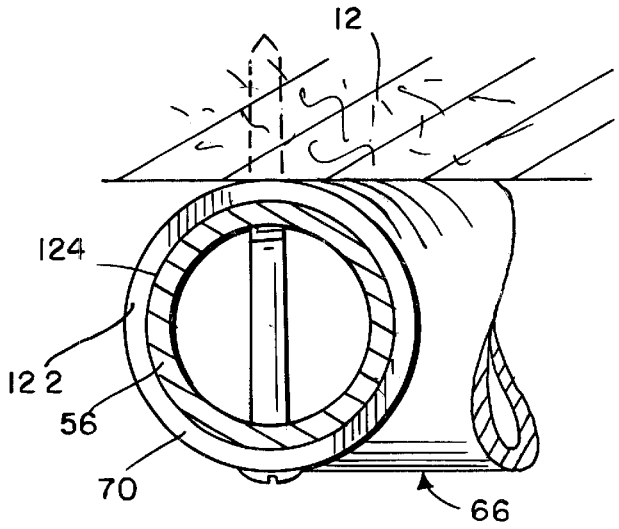
FIG. 8 is a cross-sectional view taken along line 8—8 of FIG. 6 showing one end of the second (left-side) pivot bar journaled for rotation in the left-side bar mount of the first pivot support.

A separate lock mechanism 98 is configured to brace each leg unit 14, 16 in an opened position, as shown in FIGS. 6 and 7. Each lock mechanism 98 includes a first link 100 coupled to the underside of table top 12 through a plate 110, a pair of second links 112 coupled to first link 100 and respective legs 22, 24, 46, 48 of respective leg unit 14, 16, and a sleeve 114. Sliding sleeve 114 into its locking position so that sleeve 114 covers the junction 116 of first and second links 100, 112 locks leg unit 14, 16 in the opened position, as shown in FIGS. 4 and 5. In the opened position, leg unit 14, 16 forms an angle 118 of 92 degrees, for example, measured from the underside of table top 12 in the direction leg unit 14, 16 pivots away from the collapsed position toward the opened position. Sliding sleeve 114 off junction 116 permits respective leg unit 14, 16 to pivot from the opened position back to the collapsed position.

Although the invention has been described in detail with reference to preferred embodiments, variations and modifications exist within the scope and spirit of the invention as described and defined in the following claims.

What is claimed is:

1. A table comprising:

a tabletop including a top surface and a bottom surface, a pair of leg units each including a leg, a pair of tubular side members coupled to the bottom surface of the table top, and a pair of tubular cross members, each tubular cross member being rotatably coupled to the pair of tubular side members, each leg being coupled to one of the tubular cross members for pivotable movement of each leg unit between a collapsed position and an opened position supporting the tabletop, the pair of tubular side members and the tubular cross members cooperating to form a continuous tubular frame on the bottom surface of the table.

2. The table of claim 1, wherein the side members are positioned to lie in spaced-apart, oppositional relationship, and each of the side members is U-shaped in longitudinal-section and annular-shaped in cross-section.

3. The table of claim 2, wherein each side member includes a first end face and a second end face, a first of the cross members extends between the first end face of a first of the side members and the first end face of a second of the side members, and a second of the cross members extends between the second end face of the first of the side members and the second end face of the second of the side members.

4. The table of claim 3, wherein the first end face of the first of the side members and the first end face of the second of the side members are positioned to lie in spaced-apart, facing relation, and the second end face of the first of the side members and the second end face of the second of the side members are positioned to lie in spaced-apart, facing relation.

5. The table of claim 1, wherein each cross member includes a pair of ends, each side member includes a pair of end faces and a pair of bar mounts, each bar mount is arranged to form a channel, and each end of the cross members extends through one of the end faces into one of the channels for rotation therein.

6. The table of claim 5, wherein each bar mount radially surrounds the respective end.

7. The table of claim 1, wherein each side member includes a straight rail, a pair of straight bar mounts, and a pair of elbows each interconnecting the rail and one of the bar mounts, the rail of each side member interconnects the elbows of the respective side member, and each cross member is coupled one of the bar mounts of each support bar for rotation.

8. The table of claim 7, wherein the bar mounts of each side member are positioned to lie in parallel relation, the rails are positioned to lie in parallel relation, and the rail and bar mounts of each side member are positioned to lie in perpendicular relation.

9. A table comprising:

a table top including a top surface and a bottom surface, a leg unit including a leg, a pair of tubes coupled to the bottom surface of the tabletop, each tube including a curved portion and a straight portion, and a rotatable cross member coupled to the leg, the rotatable cross member including a first end positioned to lie and rotate in a passageway formed in a first of the straight portions and a second end spaced apart from the first end and positioned to lie and rotate in a second of the straight portions to enable the leg unit to pivot about an axis of rotation established by the cross member between a collapsed position near the bottom surface of the tabletop and an opened position away from the bottom surface of the tabletop.

10. The table of claim 9, wherein the second of the straight portions is formed to include a passageway, and the second end of the rotatable cross member is positioned to lie and rotate in the passageway of the second of the straight portions.

11. The table of claim 10, wherein the passageway of the first of the straight portions radially surrounds the first end of the rotatable cross member, and the passageway of the second of the straight portions radially surrounds the second end of the rotatable cross member.

12. The table of claim 9, wherein the tubes are positioned to lie in spaced-apart, oppositional relation and each tube is U-shaped in longitudinal-section.

13. The table of claim 12, wherein each curved portion is curved about 90° and is spaced apart from the rotatable cross member.

14. A table comprising:

a table top including a top surface and a bottom surface, a pair of leg units each configured to move between a collapsed position and an opened position, the leg units being configured to support the tabletop in the opened position, and a frame including a pair of tubular, straight pivot bars each coupled to one of the leg units and a pair of tubular, U-shaped pivot supports coupled to the bottom surface of the table top and configured to support the pivot bars for rotation, the pivot bars and the pivot supports cooperating to configure the frame as endless, each pivot bar including a pair of pivot bar ends, each pivot support including a straight rail, a pair of spaced-apart elbows coupled to the rail, a pair of straight bar mounts each coupled to a different one of the elbows, and a pair of annular end faces, the rail, elbows, and bar mounts cooperating to form the U of each pivot support, each bar mount being arranged to form a channel therein and including one of the end faces, each end face being arranged to form a circular opening into one of the channels, and each pivot bar end extending through a different one of the openings into a different one of the channels for rotation so that each pivot bar is coupled to a bar mount of each pivot support for pivotable movement of the leg unit coupled thereto between the opened and collapsed positions.

15. The table of claim 14, wherein each of the pivot bars and pivot supports is annular-shaped in cross-section.

16. The table of claim 15, wherein each bar mount radially surrounds the pivot bar end coupled thereto.

17. The table of claim 14, wherein each pivot support interconnects the pivot bars and each pivot bar extends between the pivot supports.

18. The table of claim 17, wherein the pivot bars are positioned to lie in parallel relation, the bar mounts of each respective pivot support are positioned to lie in parallel relation, the rails are positioned to lie in parallel relation, and the pivot bars and bar mounts are positioned to lie perpendicular to the rails.

19. The table of claim 18, wherein each elbow is curved about 90°.

20. The table of claim 14, wherein a first of the end faces of a first of the pivot supports is positioned to lie in spaced-apart, facing relation to a first of the end faces of a second of the pivot supports, and a second of the end faces of the first of the pivot supports is positioned to lie in spaced-apart, facing relation to a second of the end faces of the second of the pivot supports.

21. A table comprising:

a table top, a pair of leg units each configured to move between a collapsed position and an opened position, the leg units being configured to support the tabletop in the opened position, and a endless frame coupled to the table top and including a pair of pivot bars each coupled to one of the leg units and a pair of spaced-apart pivot supports configured to support the pivot bars for rotation, each pivot bar being coupled to each pivot support for pivotable movement of the leg unit coupled thereto between the opened and collapsed positions, and the pivot bars and the pivot supports cooperating to configure the frame as endless.

22. The table of claim 21, wherein each pivot support includes a first end face and a second end face, a first of the pivot bars extends between the first end face of a first of the pivot supports and the first end face of a second of the pivot supports, and a second of the pivot bars extends between the second end face of the first of the pivot supports and the second end face of the second of the pivot supports.

23. The table of claim 22, wherein the first end face of the first of the pivot supports and the first end face of the second of the pivot supports are positioned to lie in spaced-apart facing relation, and the second end face of the first of the pivot supports and the second end face of the second of the pivot supports are positioned to lie in spaced-apart, facing relation.

24. The table of claim 21, wherein each pivot bar includes a pair of pivot bar ends, each pivot bar includes a pair of bar mounts, each bar mount includes an end face and is arranged to form a channel, and each pivot bar end extends through one of the end faces into one of the channels for rotation therein.

25. The table of claim 24, wherein each bar mount radially surrounds the respective pivot bar end.

26. The table of claim 21, wherein each of the pivot supports is tubular.

27. The table of claim 26, wherein each pivot support is annular-shaped in cross-section and U-shaped in longitudinal-section.

28. The table of claim 26, wherein each pivot bar is annular-shaped in cross-section.

29. The table of claim 21, wherein each pivot support includes a straight rail, a pair of straight bar mounts, and a pair of elbows each interconnecting the rail and one of the bar mounts of the respective pivot support, the rail of each pivot support interconnecting the elbows of the respective pivot support, and each pivot bar is rotatably coupled to one of the bar mounts of each pivot support.

30. The table of claim 29, wherein each elbow is curved about 90°.

31. The table of claim 29, wherein the rail, elbow, and bar mounts of each pivot support cooperate to configure the respective pivot support as U-shaped.

32. The table of claim 29, wherein the pivot bars are positioned to lie in parallel relation, the bar mounts of each respective support bar are positioned to lie in parallel relation, the rails are positioned to lie in parallel relation, and the pivot bars and bar mounts are positioned to lie perpendicular to the rails.

33. A table comprising:

a table top, a pair of leg units each configured to move between a collapsed position and an opened position, the leg units being configured to support the tabletop in the opened position, and a frame including a pair of pivot bars each coupled to one of the leg units and a pair of tubular pivot supports coupled to the table top and configured to support the pivot bars for rotation, each pivot support including a pair of end faces, each pivot bar being coupled to one of the end faces of each pivot support for pivotable movement of the leg unit coupled thereto between the opened and collapsed positions.

34. The table of claim 33, wherein the pivot supports are positioned to lie in spaced-apart, oppositional relation.

35. The table of claim 33, wherein a first of the end faces of a first of the pivot supports is positioned to lie in spaced-apart, facing relation to a first of the end faces of a second of the pivot supports, and a second of the end faces of the first of the pivot supports is positioned to lie in spaced-apart, facing relation to a second of the end faces of the second of the pivot supports.

36. The table of claim 33, wherein the pivot bars and the pivot supports cooperate to configure the frame as endless.

37. The table of claim 33, wherein each pivot bar includes a pair of pivot bar ends, each pivot support includes a pair of bar mounts, each bar mount includes one of the end faces and is arranged to form a channel, and each pivot bar end extends through one of the end faces into one of the channels for rotation therein.

38. The table of claim 37, wherein each bar mount radially surrounds the respective pivot bar end.

39. The table of claim 33, wherein each support bar is annular-shaped in cross-section.

40. The table of claim 33, wherein each pivot support includes a straight rail, a pair of straight bar mounts, and a pair of elbows, the rail of each pivot support interconnects the elbows of the respective pivot support, each elbow of each pivot support interconnects the rail and one of the bar mounts of the respective pivot support, and each pivot bar is rotatably coupled to one of the bar mounts of each pivot support.

41. The table of claim 40, wherein the rail, elbow, and bar mounts cooperate to configure the respective support bar as U-shaped.

* * * * *